United States Patent [19]

Tipton et al.

[11] Patent Number: 4,921,025

[45] Date of Patent: May 1, 1990

[54] CARBURIZED LOW SILICON STEEL ARTICLE AND PROCESS

[75] Inventors: Sheryl A. Tipton, East Peoria; Gary D. Keil, Elmwood; Gregory S. Holloway, Metamora; David R. Gromer, Morton; Gary L. Biltgen, Peoria, all of Ill.

[73] Assignee: Caterpillar Inc., Peoria, Ill.

[21] Appl. No.: 348,736

[22] PCT Filed: Dec. 14, 1988

[86] PCT No.: PCT/US88/04470

§ 371 Date: Apr. 13, 1989

§ 102(e) Date: Apr. 13, 1989

[87] PCT Pub. No.: WO89/05865

PCT Pub. Date: Jun. 29, 1989

Related U.S. Application Data

[63] Continuation-in-part of Ser. No. 135,775, Dec. 21, 1987, abandoned.

[51] Int. Cl.[5] ..... C21D 1/78

[52] U.S. Cl. ..... 148/16.5; 148/16; 148/316; 148/319; 428/627

[58] Field of Search ..... 148/16, 16.5, 316, 319; 428/627

[56] References Cited

U.S. PATENT DOCUMENTS 4,202,710 5/1980 Naito et al. ..... 148/16.5

4,836,864 6/1989 Murakami et al. ..... 148/16.5

FOREIGN PATENT DOCUMENTS 1531285 6/1968 France .

61-253346 11/1986 Japan .

OTHER PUBLICATIONS

Chemical Abstracts, vol. 107, No. 4, Jul. 27, 1987, (Columbus, Ohio, USA), p. 214, Abstract 26771e.

Naito, Takeshi et al., "Fatigue Behavior of Carburized Steel with Internal Oxides and Nonmartensitic Microstructure Near Surface", 7/84, Metallurgical Transactions A, vol. 15A, pp. 1431–1436.

*Primary Examiner*—L. Dewayne Rutledge

*Assistant Examiner*—Margery S. Phipps

*Attorney, Agent, or Firm*—Robert A. McFall

[57] ABSTRACT

A process for forming a carburized steel article includes carburizing a steel material containing not more than 0.10% silicon and less than 1.1% chromium to form an austenitic surface matrix having a high density of carbides dispersed therein. After quenching, the carburized steel article is characterized by an outer surface having a high ratio of carbides and is substantially free of intergranular oxides. As a result of preventing undesirable surface oxide formations and simultaneously providing a beneficial surface carbide structure, the bending fatigue strength, wear properties, and contact fatigue strength of articles such as gears, shafts, bearings and couplings are greatly enhanced.

18 Claims, 3 Drawing Sheets

CARBURIZED LOW SILICON STEEL ARTICLE AND PROCESS

Cross Reference to Related Application

This application is a continuation-in-part of application Ser. No. 135,775, filed Dec. 21, 1987, and now abandoned. This application was filed through the PCT Office as International Application No. PCT/US88/04470 on Dec. 14, 1988.

TECHNICAL FIELD

This invention relates generally to metal heat treatment and more particularly to case hardening with a gas containing carbon and a resulting article.

BACKGROUND ART

Carburizing is an effective method of increasing the surface hardness of low carbon, unalloyed, or low carbon, low alloy steels. Typically, steel articles are placed in an atmosphere containing carbon in an amount greater than the base carbon content of the steel and heated to a temperature above the austenite transformation temperature of the steel. After the desired amount of carbon has been diffused into the article, hardness is induced by quenching.

Gas carburizing is efficient, controllable, and one of the most widely used methods of generating a carbonaceous atmosphere for carburizing. However, most commonly used gas mixtures typically contain small amounts of oxygen which tend to form surface oxides with one or more of the steel elements which have a strong affinity for oxygen, such as silicon, chromium and manganese. Oxides that form along grain boundaries, i.e., intergranularly, extend inwardly from the surface and have a harmful effect on the mechanical properties of the carburized article.

Conventional carburizing processes typically avoid the formation of case carbides, and generally produce an essentially carbide free martensitic structure. Even when case carbides are involuntarily formed, characteristically there is a thin surface layer void of carbides. This is due to the oxidation of carbide forming elements in the surface layer.

The detrimental effects of oxidation during gas carburizing have been known for a long period of time. Heretofore, when designing a carburized article, it has been necessary to consider the reduction in bending fatigue strength attributable to intergranular surface oxides. To avoid reduction in bending fatigue properties, it has been necessary to physically remove intergranular surface oxides formed during carburizing by machining or grinding, or prevent such surface formations by removing oxygen compounds from the carburizing media. These alternatives are costly. A 1978 article authored by Ruth Chatterjee-Fischer, "Internal Oxidation During Carburizing and Heat Treating," Metallurgical Transactions A, published by American Society for Metals and the Metallurgical Society of AIME, Vol. 9A, Nov. 1978, pp. 1553–1560, reported that, when employing conventional carburizing processes, the presence of silicon in the parent metal is a prime contributor to the formation of oxides at the surface of the article. However, while identifying that lowering silicon is a solution to the problem of surface oxidation, the paper fails to recognize any interrelationship between low silicon amounts and the enhanced formation of surface carbides by nonconventional carburizing methods.

A low silicon carburizing steel, developed by Sanyo Special Steel Co., Ltd. is described in Japanese Patent Publication No. 57-23741. The Sanyo reference teaches that low silicon, i.e., 0.06% to 0.12%, when combined with relatively high carbon and chromium amounts will accelerate carbon diffusion and thereby reduce carburizing time. This reference limits the amount of chromium in the steel composition to intentionally avoid the formation of case carbides. Furthermore, this reference fails to link the influence of a low silicon composition with the formation of surface oxides and carbides during carburizing. The Sanyo low silicon steel composition described in the above publication is no longer in commercial production.

Another low silicon carburizing steel intended for use in applications wherein the formation of case carbides is purposefully avoided, was developed by Kobe Steel, Ltd. Kobe's composition is described in Japanese Patent Publication No. 61-253346 and, as described therein, was developed for use in a gear that is heat treated after carburizing to improve the hardness of the root areas of gear teeth. To assure favorable surface hardenability after carburizing, Kobe intentionally limits the amount of carbide forming elements in the steel composition to prohibit the formation of surface carbides during carburizing. Also, the amounts of silicon, manganese and chromium in the composition are restricted to prevent the formation of granular oxides which lower the heat treatability of the carburized surface layer. This reference also does not disclose any interrelationship between low silicon amounts and the beneficial formation of surface carbides.

A low silicon steel composition intended for carburized articles in which near surface carbides are formed is disclosed by Daido Special Steel Co. in Japanese Patent Publication No. 61-104065. Daido, like the above references, recognizes that restricting the amount of silicon in the steel composition is beneficial for reducing intergranular oxides. However, this reference also teaches that more than 1.2% chromium is essential to form carbides at or near within a zone extending inwardly from the surface to a depth of 0.1 mm below the surface. This reference also fails to recognize that in addition to its effect on oxidation, silicon effects surface carbide formation and, by limiting the amount of silicon in a carburizing steel as taught by the present invention, surface carbides may be easily formed with significantly smaller amounts of chromium.

Conventional gas carburizing processes, as discussed above, generally attempt to prevent the formation of case carbides. A nonconventional carburizing process for intentionally forming carbides in the case is described in Canadian Patent 610,554, "Carburization of Ferrous Alloys," issued Dec. 13, 1960, to Orville E. Cullen. Cullen teaches a method for carburizing low alloy steel by repeatedly carburizing and rapidly cooling the steel article. However, Cullen's method is very lengthy, requiring on the order of about 42 hours to complete, and is therefore quite expensive. Further, Cullen's process does not suggest a solution to the problem of surface oxide formation.

More recently, a two stage carburizing process was described in U.S. Pat. No. 4,202,710, issued May 13, 1980, to Takeshi Naito, et al. That process forms spheroidal carbides within a region between 0.1 mm and 0.4 mm below the case surface, but fails to provide a high density of carbides on the outer surface of the carburized case. As a result, articles formed by this teaching must initially wear, or be machined, down to the carbide rich zone beginning 0.1 mm below the surface before the enhanced wear and contact fatigue properties of the carbide microstructure, such as pitting and spalling resistance, can be advantageously utilized. Also, like Cullen, this process fails to offer a solution to the problem of surface oxide formation.

The present invention is directed to overcoming the problems set forth above. It is desirable to have a carburized steel article which is essentially free of surface intergranular oxides and which has a high ratio of carbides on the surface without requiring any removal of material from the carburized surface. It is also desirable to provide a process which will form this article in a short treatment time, and is economical and controllable.

DISCLOSURE OF THE INVENTION

In accordance with one aspect of the present invention, a process for forming a carburized steel article includes carburizing an article made of a steel having no more than 0.10% silicon and less than 1.1% chromium at a temperature sufficient to form, on a surface of the article, austenite having a high density of carbides dispersed therein. After carburizing, the article is quenched to transform the carburized surface microstructure to martensite, retained austenite and carbides, whereby the article has a carburized surface substantially free of intergranular oxides and has carbides comprising at least 20% of the carburized surface.

Other features of the process of forming a carburized steel article include carburizing in a first stage to form about 75% to 95% of the desired case depth, which may be advantageously followed by a second stage wherein the high density of surface carbides are formed.

In another aspect of the present invention, there is provided a carburized low silicon steel article characterized by having not more than 0.10% silicon and less than 1.1% chromium, by having an outer surface substantially free of intergranular oxides, and by having a high percentage of carbides on the outer surface. Preferably the carbides on the outer surface comprise at least 20% thereof.

Other features of the carburized low silicon article include a composition, by weight, of 0.08% to 0.35% carbon, 0.3% to 1.7% manganese, 0.2% to 2.5% carbide forming elements including said chromium, less than 6% additional hardenability agents, less than 1% grain refining elements, not more than 0.10% silicon, not more than 0.15% copper, and iron and trace elements.

BEST MODE FOR CARRYING OUT THE INVENTION

Figure 1:
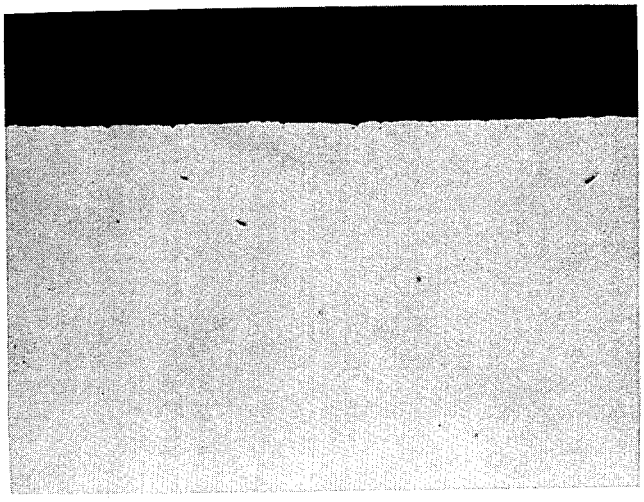
FIG. 1 is a photomicrograph, at 750X, showing an unetched section of a carburized low silicon steel article containing less than 0.10% silicon according to the present invention.

A process for forming a steel article includes the steps of selecting a low silicon steel, shaping the steel, carburizing, controllably cooling to the hardening temperature, and quenching. As used herein the term "low silicon steel" means a steel material containing from 0% silicon to no more than 0.10% silicon, and whose composition in all other respects is recognized as generally suitable for carburizing. Restricting, or eliminating, the amount of silicon in the steel not only represses the formation of silicon oxides but also inhibits the oxidation of chromium and manganese on the surface of the carburized article. Furthermore, when low silicon steel articles are processed in accordance with the present invention, the formation of a high ratio of carbides on the surface is assured. Accordingly, selection of an appropriate steel composition is an important step.

Commercially produced low alloy carburizing grade steels typically have a composition, by weight, within the following ranges:

| | |
|---|---|
| Carbon | 0.08%-0.35% |
| Manganese | 0.3%-1.7% |
| Carbide forming elements such as Chromium, Molybdenum or Vanadium (total) | 0.2%-2.5% |
| Additional Hardenability agents | 0.0%-6% |
| Silicon | 0.15%-0.35% |
| Grain refining elements | 0.0%-1.0% |
| Iron and residual elements | Balance |

The above steel composition, if silicon is deleted or restricted to 0.10% or less, is suitable for the formation of carburized articles according to the present invention.

The accepted steel industry standard allowable residual amount of copper is steel compositions is 0.35%. It has been found that low silicon steels having copper toward the upper limit of such amount are sometimes inconsistent in the formation of carbides on the carburized surface. It is theorized that copper may inhibit the formation of surface carbides. Accordingly it is desirable, though apparently not essential in all cases, to limit the amount of copper in the composition to not more than 0.15%.

More specifically, a low alloy carburizing grade steel, such as one of the SAE 4110 to 4130 series, all modified particularly to limit silicon to no more than 0.10%, are particularly suited for the formation of carburized articles such as gears, bearings and shafts. Therefore, commercial low alloy carburizing grade steels containing relatively small but essential amounts of carbide forming elements such as chromium, molybdenum or vanadium, may be modified to be a low silicon steel composition. Additional hardenability agents may be included but should be limited to amounts less than about 6%. Grain refining elements in amounts less than 1% are often added to promote fine grain size. As noted above, it is also desirable to limit residual or trace amounts of copper to no more than 0.15% to further enhance surface carbide formation. Deleterious elements such as phosphorus and sulfur, often present in trace amounts, are preferably limited to no more than 0.05% and 0.08% respectively.

Articles having any of the above described compositions are shaped to a predetermined form by machining from rolled steel, by casting or forging, by consolidating steel powder, or by a combination of forming operations.

After shaping, the article is placed into a carburizing furnace and heated to a temperature sufficient to diffuse carbon from the furnace atmosphere into the article and to form a high density of carbides on the surface of the article. Preferably, the carburizing operation is carried out in two stages. In the first carburizing stage, the carbon potential of the gas atmosphere in the furnace is maintained at a level about equal to the saturation limit of carbon in austenite. The saturation level of carbon in austenite, generally designated as "$A_{cm}$", is temperature dependent. The shaped article is preferably placed directly into a continuous type furnace having a temperature within the carburizing chamber of from about 1550° F. (843°C.) to about 1850° F. (1010° C.) and an atmosphere about equal to the $A_{cm}$ corresponding the specific steel composition of the article.

Figure 7:
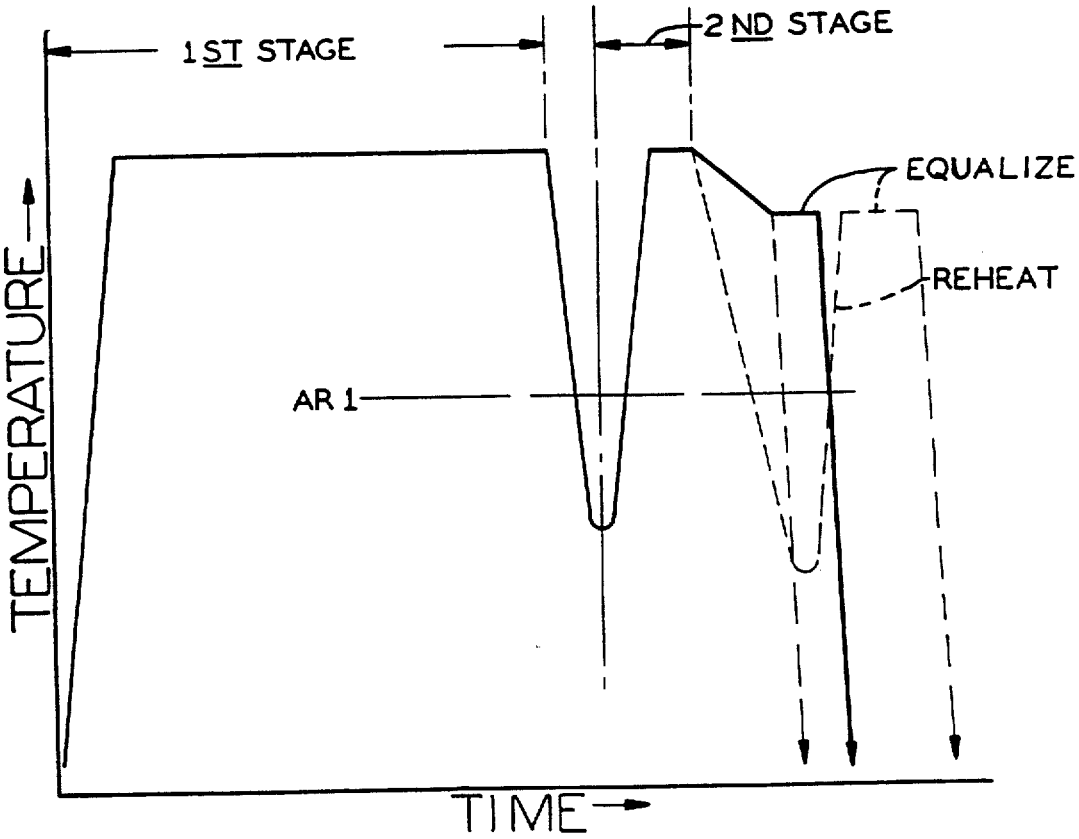
FIG. 7 is a graph illustrating the time and temperature relationship of the carburizing process embodying the present invention.

As shown graphically on FIG. 7, the first stage of the carburizing process includes holding the article in the carburizing chamber for a period of time sufficient to develop about 75% to 95% of the desired final case depth. As used herein, "case depth" is the distance below the surface where the carbon content is at 0.40%. The time required to achieve the desired case depth of the article is dependent on a number of parameters, such as the chemical composition of the article, and composition and temperature of the gas atmosphere. Hence the length of time that the article is held in the carburizing chamber in this first stage may vary from about 2 to about 25 hours. When the article has the low silicon composition described above, the furnace atmosphere is maintained as close as possible to the $A_{cm}$ of the particular steel, and the carburizing temperature is maintained at about 1700° F. (927° C.), an initial case depth of about 1.0 mm can be achieved by holding the article in the furnace for about 4 to 5 hours. After completion of the second stage carburizing operation, described below, the final case depth is about 1.1 mm.

After the first stage carburizing operation, the article is cooled, preferably by gas quenching, to a temperature below that at which bainite and pearlite begin to form. This temperature is commonly designated as "$A_{rl}$" and is represented by the dashed horizontal line on FIG. 7. It is desirable to cool the surface of the article rapidly in this operation to suppress network carbide formation. This results in the formation of a supersaturated, metastable, solid solution of iron and carbon. If excessively slow cooling rates are used, carbides will form at grain boundaries, and not provide effective intragranular nuclei for the formation of carbides.

After cooling the article to a temperature sufficiently below $A_{rl}$ to assure the substantially complete transformation to bainite or pearlite, the article is quickly reheated by placing it into a preheated carburizing furnace. This causes a homogenous carbide precipitation from the metastable solid solution, and results in a dispersion of carbides in the case microstructure.

During the second stage carburizing operation, the carbon potential of the furnace atmosphere is maintained at a level above the $A_{cm}$, i.e., the carbon potential of the atmosphere is above the saturation limit of carbon in austenite of the article. For example, an atmosphere having a carbon potential of about 1.5% to 2% can be provided by a gas having a composition of 0.055% $CO_2$, 1% $CH_4$, 20% CO, 40% $H_2$ and the balance $N_2$. Typically, the temperature of the second stage carburizing chamber is maintained between about 1550° F. (843° C.) and 1850° F. (1010° C.), and preferably at about 1700° F. (927° C.). In the second stage it is only necessary to reaustenitize the case of the article in a supersaturated gas environment, and thereby increase the surface carbon to a level above 1.5%. The article need be held for only about 15 to 60 minutes at 1700° F. (927° C.) to achieve the desired case carbon content. Although lower temperatures may be used, it will require holding the article in the furnace for a corresponding longer time. Also, it has been found that the size and volume fraction of the surface carbides present in the carburized article can be controlled by selection of the second stage carburizing temperature and the rate of cooling in the subsequent cooling step described below. For example, higher second stage carburizing temperatures tend to produce more carbides, i.e., a higher volume fraction of larger carbides, on the surface of the article.

Upon completion of the second stage carburizing operation an austenitic microstructure having a high density of well dispersed surface carbides has been formed. The article, preferably while still in the furnace, is then controllably cooled to the hardening temperature of the steel core. By way of example, the hardening temperature of SAE 4118 steel having a low silicon composition, is about 1540° F. (838° C.). During the cooling operation, the previously formed carbides increase in size and volume fraction. To achieve this, the cooling rate of the article from the carburizing to hardening temperature is carefully controlled. Advantageously, the cooling rate is about 1° F. (0.6° C.) to 20° F. (11° C.) per minute.

After cooling the surface of the article to the hardening temperature, it is desirable to maintain the article at the hardening temperature for a length of time sufficient to permit the temperature in the core of the article to cool to the hardening temperature. This process, known as equalizing, is identified in the process diagram shown in FIG. 7. Although desirable to minimize distortion, equalizing is not essential to obtain the desired surface microstructure. Depending on the article's mass and geometry, equalizing typically takes about 5 to 60 minutes to complete.

A carbonaceous gas atmosphere is advantageously maintained about the article during the preceding cooling and equalizing operations to prevent carbon depletion at the surface of the article. Both cooling and equalizing may be carried out in the second stage carburizing furnace, or in an interconnecting chamber, so that the same gas atmosphere used in carburizing may be simply cooled and circulated about the article.

After equalizing, the article is preferably directly quenched from the hardening temperature at a rate sufficiently rapid to transform the surface microstructure to martensite, retained austenite and carbides. For this, an oil medium is used with a quench rate high enough to assure the desired surface transformation.

If it is not convenient to directly quench the article immediately after equalizing, alternative steps represented by the dashed line in FIG. 7 have been developed. In one alternative, the article may be cooled and then reheated to the hardening temperature of the steel, equalized and quenched. In another alternative, if the mass and geometry of the article are sufficiently small, and the controlled cooling rate sufficiently slow, equalizing may not be required. If these conditions are present, the article may be quenched directly after the controlled slow cooling step.

Shafts and gears are exemplary of articles subjected to high bending loads, surface wear and contact fatigue. Samples of these articles have been successfully formed in accordance with the above described process. The total time required to complete the carburizing process, including the final quench, was typically only about 7 hrs. Thus, the described process not only forms articles having improved metallurgical surface characteristics without requiring further finishing of the carburized surface, but it is also much faster than prior art methods for forming desirable surface carbide structures.

Figure 2:
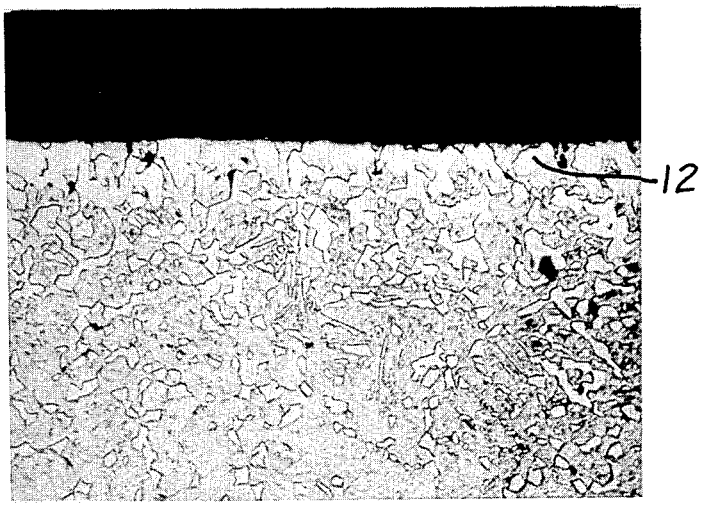
FIG. 2 is a photomicrograph, at 750X, of an etched section of the article shown in FIG. 1.
Figure 3:
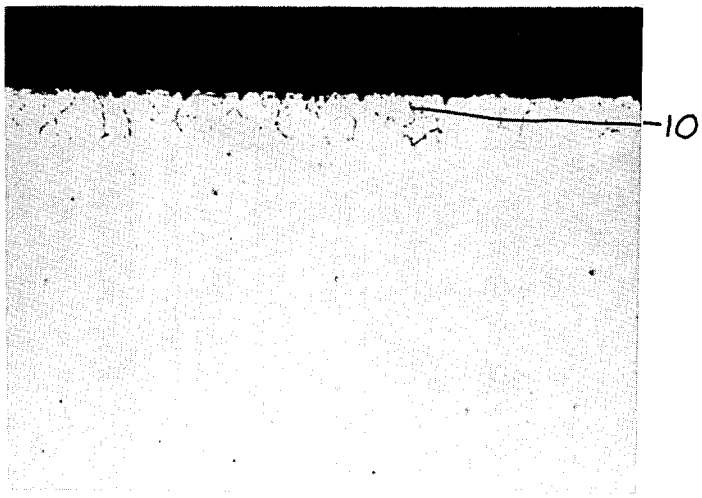
FIG. 3 is a photomicrograph, at 750X, showing an unetched section of an article carburized with the article in FIG. 1, but formed of a typical carburizing grade low alloy steel containing 0.26% silicon.
Figure 4:
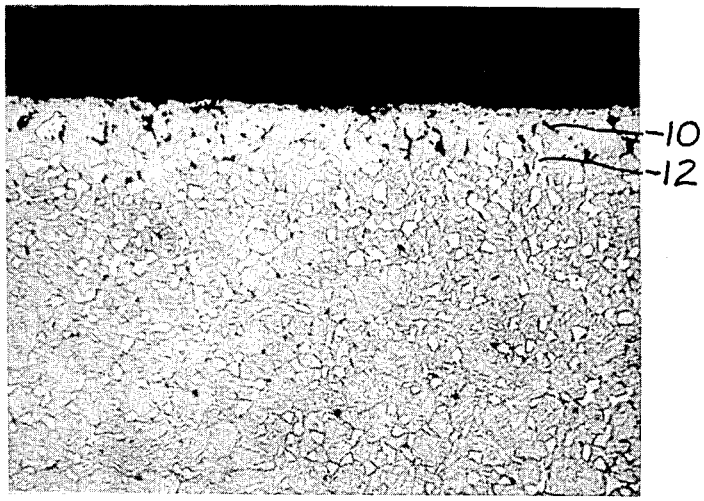
FIG. 4 is a photomicrograph, at 750X, of an etched section of the article shown FIG. 3.
Figure 5:
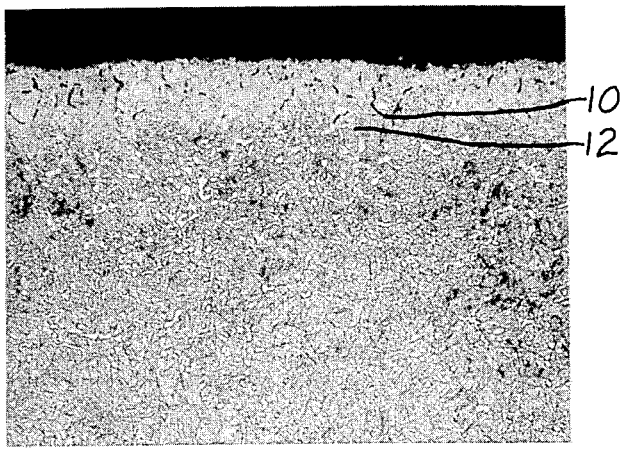
FIG. 5 is a photomicrograph, at 500X, showing an etched section of an article formed of a typical carburizing grade low alloy steel containing 0.26% silicon and carburized by a conventional carburizing process.

Photomicrographs of a representative sample of an article embodying the present invention are shown in FIGS. 1 and 2. Advantages of the present invention are emphasized by contrasting it with FIGS. 3 to 5 which are photomicrographs of representative samples of articles formed differently as described below. FIGS. 1 and 3, are photomicrographs of polished and unetched samples in which intergranular oxides are identified. FIGS. 2 and 4 are the same samples as FIGS. 1 and 3, but etched with a conventional 1% nital solution to better define the carbides in the microstructure. FIG. 5 is a sample of an article given a conventional heat treat, and polished and etched with 1% nital solution. In the photomicrographs, intergranular oxides appear as elongated black areas in the unetched samples. Typical intergranular oxide formations are identified by the reference numeral 10. Carbide structures appear in the photomicrographs of the etched samples as white areas, typical ones of which are identified by the reference numeral 12.

EXAMPLE 1

A representative sample of an article formed according to one embodiment of the present invention has a microstructure as shown in section, at 750X, in FIGS. 1 and 2. The sample was cut from a modified wrought SAE 4118 steel having the following specific composition:

| | |
|---|---|
| Carbon | 0.23% |
| Manganese | 0.99% |
| Phosphorus | 0.009% |
| Sulfur | 0.010% |
| Silicon | 0.04% |
| Chromium | 0.40% |
| Molybdenum | 0.13% |
| Aluminum | 0.029% |
| Copper | 0.03% |
| Iron and residual elements | Balance |

The sample was placed in a carburizing furnace having a conventional endothermic gas carburizing atmosphere comprising about 0.07% $CO_2$, 0.6% $CH_4$, 20% CO, 40% H, and the balance $N_2$. The furnace was preheated to a temperature of about 1700° F. (927° C.). The carbon potential of the atmosphere was maintained as close as the furnace control system permitted to the $A_{cm}$, the carbon in austenite solubility limit of the above described steel composition. The article was held in the furnace, at the same temperature and atmosphere for 4 ½ hrs, and then gas quenched to 200° F. (93° C.). After cooling subsequent to the first carburizing operation, the article was placed in a carburizing furnace, preheated to about 1700° F. (927° C.), and the gas atmosphere controlled so that the carbon potential of the gas was greater than the saturation limit of carbon in the steel material's austenite phase. The article was held in the carbon rich atmosphere, at the same temperature, for about 30 minutes, and then slowly cooled over a period of about 60 minutes, i.e., at a rate of about 2.7° F./minute (1.5° C./minute) to 1540° F. (838° C.), the hardening temperature of the steel. The article was held at 1540° F. (838° C.) for about 40 minutes to allow the temperature of interior portions of the article to equalize to the hardening temperature. After equalizing, the article was directly quenched in an oil medium.

As may be seen in the photo of a micrographic sample of the article in FIG. 2, the article has a high volume ratio of carbides 12 formed on the as-carburized surface. Direct measurement of the carbides on the surface immediately adjacent the band of black bedding material observable along the very top of the photomicrograph shows that carbides comprise about 50% of the article's surface area. Furthermore, as best shown in the unetched section shown in FIG. 1, the carbide rich area formed on the surface of the article is essentially free of intergranular oxides.

EXAMPLE 2

A second article, a micrographic sample of which is shown in FIGS. 3 and 4, was formed from modified wrought SAE 4118 steel having a silicon content within the typical range of silicon for commercially produced heats of similar material. Specifically, the article in this example has the following composition:

| | |
|---|---|
| Carbon | 0.22% |
| Manganese | 0.76% |
| Phosphorus | 0.009% |
| Sulfur | 0.016% |
| Silicon | 0.26% |
| Chromium | 0.78% |
| Molybdenum | 0.24% |
| Aluminum | 0.033% |
| Copper | 0.12% |
| Iron and residual elements | Balance |

The material in this example has a silicon content of 0.26%, representative of silicon amounts normally present in conventional carburizing grade steels having a similar composition. The article formed of the above material was heat treated simultaneously with the article described in Example 1, i.e., according to the process of the present invention.

FIG. 4 illustrates the influence of increased amounts of silicon on surface carbide formation. There are virtually no carbides 12 on the surface of this sample. Furthermore, the carbide free surface layer is commensurate with the depth of the intergranular oxides 10. Therefore, even when employing a case carbide forming, nonconventional carburizing process, it is necessary to limit the amount of silicon in the base steel to assure the formation of significant carbide structures on the surface of the carburized article. Further, as best seen in FIG. 3, intergranular oxides 10 are present in significantly greater quantity than in the low silicon material of FIG. 1. The ratio of intergranular oxides to length of article surface shown in the field of view is about 0.50:1. That is, when measured along their major axes, the length of the intergranular oxides visible in FIG. 3 total about 50% of the length of the surface in the same field of view.

EXAMPLE 3

A sample of an article having a modified SAE 4118H composition with 0.26% silicon, and given a conventional single stage carburizing treatment, is shown in FIG. 5. The article has the following composition:

| | |
|---|---|
| Carbon | 0.21% |
| Manganese | 0.93% |
| Phosphorus | 0.011% |
| Sulfur | 0.013% |
| Silicon | 0.26% |
| Chromium | 0.95% |
| Molybdenum | 0.34% |
| Aluminum | 0.032% |
| Copper | 0.06% |
| Iron and residual elements | Balance |

This example illustrates the metallurgical surface characteristics of conventionally treated standard carburizing grade steel in which case carbides were formed. In particular, there is a typical carbide depleted zone extending about 0.02 mm below the surface of the article. Within this zone there are a significant number of oxide formations, both intergranular and intragranular. As is well known, intergranular oxides 10 have a deleterious affect on bending fatigue properties. Furthermore, because there are no carbides on the surface, about 0.02 mm of the article's outer surface must be worn away before the benefit of the carbide structures can be used advantageously.

As can be seen from the above examples there are several features of the described embodiment. First, the steel material from which an article is formed must contain no more than 0.10% silicon. Limiting the silicon content to this amount not only inhibits the formation of intergranular oxides, but also promotes and enhances the formation of desirable carbide structures on the surface. Secondly, a high ratio of carbides are formed on the outer surface of the article, (i.e., the as-carburized surface without any material removal therefrom), and not at some finite depth, e.g. 0.1 mm or more, below the surface. To accomplish this most advantageously, the article is carburized in the manner described to assure the formation of a high density of carbides well dispersed in austenite on the article surface prior to growth by controlled cooling. As seen from Examples 2 and 3, if either of these two features are missing, the carburized article will not have an outer surface which is essentially free of intergranular oxides and on which a high volume ratio of carbides are formed.

EXAMPLE 4

A number of samples having similar base compositions except for silicon amounts, and in two examples, chromium, were prepared and heat treated by the carburizing process described in Example 1, above. The samples were then cut, polished, and analyzed for the presence of intergranular oxides and surface carbides. Specifically, nine samples having compositions as listed below were tested:

| Sample | COMPOSITION (Balance Fe and residual elements) | | | | | | | *SURFACE RATINGS* | |
|---|---|---|---|---|---|---|---|---|---|
| | | | | | | | | Intgr. Oxides | Carbides |
| No. | % C | % Mn | % Cr | % Mo | % Al | % Cu | % Si | % ratio | % ratio |
| a | 0.22 | 0.67 | 0.89 | 0.19 | 0.003 | 0.02 | 0.01 | 0% | 51% |
| b | .23 | .98 | .43 | .13 | .040 | .03 | .04 | 1 | 45 |
| c | .23 | .89 | .45 | .21 | .033 | .03 | .06 | 6 | 42 |
| d | .23 | .84 | .45 | .20 | .029 | .03 | .09 | 8 | 27 |
| e | .23 | .83 | .44 | .20 | .027 | .03 | .11 | 13 | 10 |
| f | .22 | .80 | .44 | .20 | .030 | .03 | .12 | 17 | 17 |
| g | .22 | .78 | .44 | .20 | .025 | .03 | .14 | 26 | 12 |
| h | .23 | .77 | .45 | .20 | .023 | .03 | .18 | 25 | 8 |
| i | .22 | .76 | .78 | .24 | .033 | .12 | .26 | 37 | 0 |

The total length of intergranular oxides, measured along the major axes of the oxides in three equally-sized representative fields in a section of each sample, were averaged and expressed as a % ratio to the length of the article's outer surface in the field of view. Similarly, the percent of linear surface at which carbides are present was measured in three equally-sized representative fields in a section of each sample, averaged, and expressed as a % ratio to the length of the article surface in the representative field of view.

Figure 6:
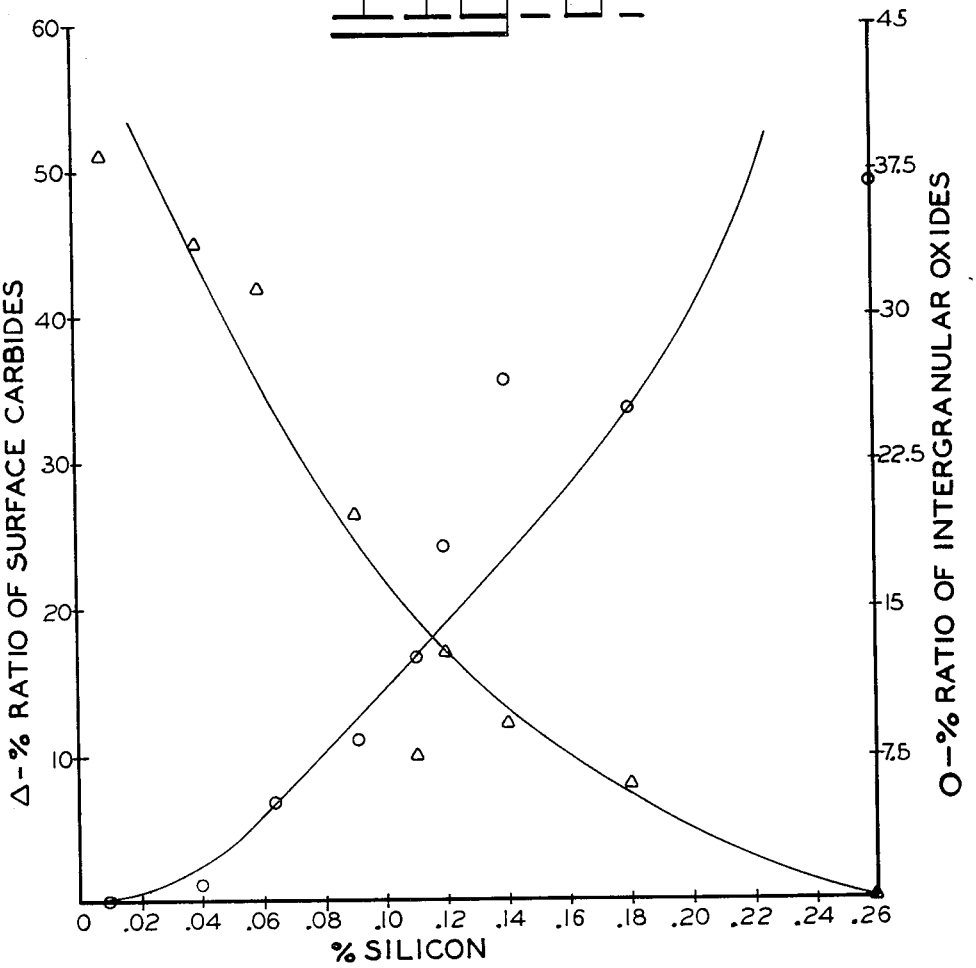
FIG. 6 is a graph showing the relationship between silicon content in the steel composition, and the amount of oxides and carbides formed on the surface of an article carburized according to the present invention.

The results of the above measurements are shown in a graphical form in FIG. 6. The % ratio of oxides for each of the above samples is represented on the graph by a small circular symbol. The scale for % silicon is shown along the base of the graph, and the scale for % ratio of oxides is shown along the right vertical side. As shown by the solid line representing a reasonable fit for the plotted data points, the amount of intergranular oxides increases with increasing silicon content in the samples. The data indicates that for these particular samples, the silicon content may be as high as 0.11% or 0.12% and still yield less than about a 15% ratio of intergranular oxides with respect to a representative surface length.

In similar fashion, the % ratio of carbides for each of the above samples is represented on the graph by a small triangular-shaped symbol, and plotted according to the scale shown along the left vertical side of the graph. A line, representing a reasonable fit of the individual data points, readily shows that the % ratio of carbides with the respect to the surface generally decreases with increases in silicon in the samples. Sample e appears to have a lower carbide ratio than either sample d or f, respectively representing lower and higher silicon amounts on each side of sample e. For this reason, although the integrated data suggests that, for the above representative group of samples, a silicon content of about 0.11% or 0.12% will provide a desirable carbide level of about 20%, a preferred limit of about 0.10% silicon will more consistently assure that the carbide to surface ratio in the carburized article will be above 20%.

INDUSTRIAL APPLICABILITY

Articles formed according to the above are particularly useful as gears, couplings, shafts, bearings, and similar articles subjected to a combination of high bending loads, surface wear and contact fatigue.

It has been found that low silicon steel with restricted residual amounts of copper is priced about the same as conventional carburizing grade alloy steels. Accordingly, since the process is more economical than many conventional processes, it is felt that the process may have wide applicability and the resulting articles, which do not require any further finishing of the carburized surface, may also be widely used where carburized articles are required.

It is now deemed apparent that there has been described a carburizing process for low silicon steel material to form a high ratio of carbides on the outer surface of an article substantially free of intergranular surface oxides. It is known that intergranular surface oxides reduce the bending fatigue strength of articles. It is also known that high density carbide structures have high hardness and contribute to increased wear and contact fatigue life. As a result of preventing undesirable surface oxide formations and simultaneously providing beneficial surface carbide structures on the as-carburized surface, the bending fatigue strength, wear properties, and contact fatigue properties of articles formed as described are greatly enhanced.

Other aspects, features and advantages of the present invention can be obtained from a study of this disclosure together with the appended claims.

We claim:

1. A process for forming a steel article having a carburized surface substantially free of intergranular oxides and having carbides on said carburized surface comprising at least 20% thereof, not requiring any further finishing, including the steps of:

selecting a steel material having, by weight percent, from about 0.08% to about 0.35% carbon, from about 0.3% to about 1.7% manganese, not more than 0.10% silicon, not more than 0.15% copper, less than 1.1% chromium, from about 0.2% to about 2.5% carbide forming elements including said chromium, less than 6% additional hardenability agents, less than 1% grain refining elements, and the balance iron and trace impurities;

shaping the steel material to form an article;

carburizing said article at a temperature and for a period of time sufficient to form a surface comprising austenite and a high density of carbides dispersed in said austenite;

quenching said carburized article to transform the surface into a microstructure of martensite, retained austenite and carbides; and controlling the steps of carburizing and quenching so that the carbides comprise at least 20% of said surface, and the surface is substantially free of intergranular oxides, thereby producing a carburized steel article not requiring any further finishing of the carburized surface.

2. A process for forming a carburized steel article, as set forth in claim 1, wherein the step of quenching the carburized article from the hardening temperature of the steel material includes quenching in an oil medium.

3. A process for forming a carburized steel article, as set forth in claim 1, including prior to quenching, the step of controllably cooling at least the surface of the carburized article from the carburizing temperature to the hardening temperature of said steel material at a rate sufficient to assure that the carbides increase in size and form a higher surface fraction of carbides.

4. A process for forming a carburized steel article, as set forth in claim 3, wherein the step of cooling said carburized article to the hardening temperature includes reducing the temperature of the furnace atmosphere at a rate of from about 1° F./minute (0.6° C./minute) to about 20° F./minute (11° C./minute).

5. A process for forming a carburized steel article, as set forth in claim 3, including after cooling to the hardening temperature, the step of maintaining said carburized article at the hardening temperature of the steel material for a time sufficient to permit the core temperature of the article to equalize at said hardening temperature.

6. A process for forming a carburized steel article, as set forth in claim 5, wherein the step of maintaining said carburized article at the hardening temperature of the steel material includes maintaining the article at a temperature of about 1540° F. (838° C.) for from about 5 minutes to about 60 minutes.

7. A process for forming a carburized steel article, as set forth in claim 1, wherein the step of carburizing said article includes a first stage in which the article is placed in a preheated furnace having a temperature of from about 1550° F. (843° C.) to about 1850° F. (1010° C.) and an atmosphere in which the carbon content is maintained essentially in equilibrium with austenite saturated with carbon at the furnace temperature, and held in said furnace for a period of time sufficient to form from about 75% to about 95% of the final case depth.

8. A process for forming a carburized steel article, as set forth in claim 7, wherein during said first stage the furnace temperature is maintained at about 1700° F. (927° C.) and said article is held in said furnace from about 4 to about 5 hours.

9. A process for forming a carburized steel article, as set forth in claim 7, wherein the step of carburizing includes gas quenching said article after the first stage carburizing, said quenching being at a rate sufficient to suppress carbide nucleation in the carbuized case and maintaining said rate until the case temperature is below the temperature at which the transformation of austenite is essentially complete.

10. A process for forming a carburized steel article, as set forth in claim 9, wherein the step of carburizing the article includes a second stage in which the article is placed in a preheated furnace having a temperature of from about 1550° F. (843° C.) to about 1850° F. (1010° C.) and an atmosphere in which the carbon content is maintained at a level greater than the saturation limit of carbon in austenite at the furnace temperature, and held in said furnace for a period of time sufficient to transform the surface to an essentially austenitic microstructure having a high density of surface carbides dispersed in said austenite.

11. A process for forming a carburized steel article, as set forth in claim 10, wherein during the second stage, the furnace temperature is maintained at about 1700° F. (927° C.) and the article is held in said furnace for from about 15 minutes to about 60 minutes.

12. A process of carburizing a low silicon steel article, to provide an article having an as-carburized surface which is substantially free of intergranular oxides and with carbides on at least 20% thereof, including the steps of:

carburizing an article made of a steel having no more than 0.10% silicon by weight and less than 1.1% chromium by weight at a temperature and for a time sufficient to form, on a surface of the article, austenite having a high density of carbides dispersed therein thereby forming a carburized surface; and thereafter controllably quenching the article to transform the carburized surface microstructure to martensite, retained austenite and carbides; so that the article has an as-carburized surface substantially free of intergranular oxides and has carbides comprising at least 20% of said carburized surface, thereby producing a carburized low silicon steel article not requiring any further finishing of the carburized surface.

13. A carburized low silicon steel article characterized by having not more than 0.1% silicon and less than 1.1% chromium, by having a carburized surface that, without any material removed therefrom, is substantially free of detrimental intergranular oxides, and has carbides on said carburized surface which comprise at least 20% of the area of the carburized surface, and does not require further finishing.

14. A carburized low silicon steel article, as set forth in claim 13 which is virtually free of any intergranular oxides at the entire carburized surface.

15. A carburized low silicon steel article, as set forth in claim 13, wherein the total length of the intergranular oxides in a representative cross-section of the article is not more than about 15% of the length of the carburized surface of the article in said cross-section.

16. A carburized low silicon steel article, as set forth in claim 13, wherein the article's composition, by weight, includes about 0.08% to 0.35% carbon and about 0.2% to 2.5% carbide forming elements including said chromium.

17. A carburized low silicon steel article, as set forth in claim 13, wherein said article has a composition consisting essentially of by weight, of 0.08% to 0.35% carbon, 0.3% to 1.7% manganese, not more than 0.10% silicon, less than 1.1% chromium, 0.2% to 2.5% carbide forming elements including said chromium, less than 6% additional hardenability agents, less than 1% grain refining elements, not more than 0.15% copper, and the balance iron and trace impurities.

18. A carburized steel article, as set forth in claim 17, wherein carbon is present in an amount from 0.18% to 0.24%, manganese is present in an amount from 0.8% to 1.1%, chromium is present in an amount from 0.4% to 1.1%, molybdenum is present in an amount from 0.1% to 0.5%, silicon is present in an amount of not more than 0.05%, not more than 0.15% copper, and the trace impurities include no more than 0.05% phosphorus and no more than 0.08% sulfur.

* * * * *

UNITED STATES PATENT AND TRADEMARK OFFICE

CERTIFICATE OF CORRECTION

PATENT NO. : 4,921,025

DATED : May 1, 1990

INVENTOR(S) : Sheryl A. Tipton, et al

It is certified that error appears in the above-identified patent and that said Letters Patent is hereby corrected as shown below:

The sheet of drawing consisting of Fig. 7, should be added as shown on the attached sheet.

Signed and Sealed this

Twenty-ninth Day of January, 1991

*Attest:*

HARRY F. MANBECK, JR.

*Attesting Officer*

*Commissioner of Patents and Trademarks*